US008567069B2

(12) United States Patent
Robinson et al.

(10) Patent No.: US 8,567,069 B2
(45) Date of Patent: Oct. 29, 2013

(54) BLADE LOCK AND RELEASE MECHANISMS FOR UTILITY KNIVES

(75) Inventors: Glenn Robinson, Coral Springs, FL (US); Michael Martinez, Oakland Park, FL (US)

(73) Assignee: IBT Holdings, LLC, Deerfield Beach, FL (US)

( * ) Notice: Subject to any disclaimer, the term of this patent is extended or adjusted under 35 U.S.C. 154(b) by 458 days.

(21) Appl. No.: 12/798,761

(22) Filed: Apr. 9, 2010

(65) Prior Publication Data

US 2010/0263214 A1 Oct. 21, 2010

Related U.S. Application Data

(60) Provisional application No. 61/212,868, filed on Apr. 17, 2009.

(51) Int. Cl.
*B26B 3/06* (2006.01)

(52) U.S. Cl.
USPC ..... 30/155; 30/160; 30/161; 30/329

(58) Field of Classification Search
USPC ..... 30/161, 160, 331, 155–157, 329, 339
See application file for complete search history.

(56) References Cited

U.S. PATENT DOCUMENTS

| | | | | |
|---|---|---|---|---|
| 4,979,301 | A * | 12/1990 | Walker | 30/161 |
| 6,357,120 | B1 * | 3/2002 | Khachatoorian et al. | 30/162 |
| 6,915,577 | B2 * | 7/2005 | Scala | 30/156 |
| 7,337,546 | B2 * | 3/2008 | Cheng | 30/156 |
| 7,380,341 | B2 * | 6/2008 | Ping | 30/161 |
| 7,552,537 | B2 * | 6/2009 | Ye | 30/161 |
| 7,814,664 | B2 * | 10/2010 | LeBlanc et al. | 30/161 |
| 2003/0037444 | A1 * | 2/2003 | Chunn | 30/337 |
| 2005/0055833 | A1 * | 3/2005 | Scarla | 30/156 |
| 2005/0204567 | A1 * | 9/2005 | Ping | 30/161 |
| 2005/0274024 | A1 * | 12/2005 | Jinliang | 30/153 |
| 2009/0165309 | A1 * | 7/2009 | Kamb et al. | 30/161 |
| 2010/0299935 | A1 * | 12/2010 | Ping | 30/161 |
| 2011/0023308 | A1 * | 2/2011 | Ping | 30/161 |

* cited by examiner

*Primary Examiner* — Omar Flores Sanchez
(74) *Attorney, Agent, or Firm* — Dan M. DeLaRosa

(57) ABSTRACT

A folding utility knife with a blade lock and release mechanism is provided, and the knife comprises: a handle pivotally connected to a blade holding compartment, the handle comprising at least two side walls forming a space, the space of the handle is designed to encase at least a portion of the blade holding compartment during a folded position, the blade holding compartment comprising at least one side wall having at least two internal cavities, the first cavity for holding a blade with at least two indentations, at least a portion of the blade holding compartment designed to be situated within the space of the handle during a folded position, the blade holding compartment comprises a front end, a rear end and a faceplate for covering the internal cavities, the front end of the blade compartment holder and at least a portion of the faceplate forming an opening at the front end of the blade holding compartment which allows a portion of the blade to protrude from the blade holding compartment; and a blade lock and release device comprising a moveable arm having front and rear portions, and the rear portion of the arm is pivotally attached adjacent to the rear end of the blade holding compartment, the arm is designed to fit within the second cavity of the blade holding compartment, the front portion of the arm having at least two protrusions for engagement and disengagement with the blade, the protrusions of the arm contacting the indentations of the blade during a locked position, the protrusions of the arm being moved away from the indentation.

16 Claims, 4 Drawing Sheets

1
2
3
14
6
9

1
2
3
14
6

1
2
3
14
13a
13b
6

1
2
3
14
13a
13b
16
5a
5b

BLADE LOCK AND RELEASE MECHANISMS FOR UTILITY KNIVES

RELATED APPLICATION

This application is related to U.S. Provisional Application Ser. No. 61/212,868 entitled "Blade Lock And Release Mechanisms For Utility Knife" which was filed on Apr. 17, 2009.

BACKGROUND OF THE INVENTION

1. Field of the Invention

This invention relates to a folding utility knife and more specifically, to a utility knife with a blade lock and release mechanism.

2. Description of the Related Art

There are various patents covering folding utility knife type devices. These patents cover folding utility knives that have blade holding compartments such as U.S. Pat. No. 6,688,003 to Scarla, U.S. Pat. No. 6,354,007 to Scarla, U.S. Pat. No. 6,968,622 to Ping, U.S. Pat. No. 7,007,392 to Ping, U.S. Pat. No. 7,040,022 to Ping and U.S. Pat. No. 7,134,207 to Ping. These patents do not provide for any easy mechanism for releasing the blade and do not provide a way to effective remove and replace the blade.

The present invention provides for folding utility knives with a new and improved blade lock and release mechanism. The present invention overcomes numerous problems presented by the prior art.

SUMMARY OF THE INVENTION

In one embodiment, the present invention provides for a folding utility knife, the knife comprises: folding utility knife comprising: a handle comprising an internal space; a blade holding compartment pivotally connected to said handle, the blade holding compartment comprising at least one side wall having at least two internal cavities, the first cavity for holding a blade, at least a portion of the blade holding compartment is designed to be situated within the space of the handle during a folded position, the blade holding compartment comprises a front end, a rear end and a faceplate for covering the internal cavities, the front end of the blade compartment holder and at least a portion of the faceplate forming an opening at the front end of the blade holding compartment which allows a portion of the blade to protrude from the blade holding compartment; and a blade lock and release device comprising a moveable arm having front and rear portions, the rear portion of the arm is pivotally attached adjacent to the rear end of the blade holding compartment, the front portion of the arm has at least one protrusion for engagement and disengagement with the blade, and the protrusion of the arm contacts the blade during a locked position, and the arm is moved to allow the protrusion of the arm to disengage contact with the blade during a released position.

In another embodiment, the knife further comprises an interchangeable blade having at least one side with a sharp edge for cutting, at least a portion of the blade is situated within the blade cavity of the blade holding compartment and a portion of the blade is situated outside of the blade holding compartment to expose at least a portion of the sharp edge of the blade.

In still another embodiment, the blade lock and release device further comprises a mechanism for allowing the engagement and disengagement of the arm with the blade. In yet another embodiment, the mechanism comprises a push and slide button and at least one spring.

In still yet another embodiment, the spring is situated between the push and slide button and the arm of said blade lock and release device. In a further embodiment, the spring contacts at least a portion of the push and slide button and at least a portion of the arm of the blade lock and release device.

In another further embodiment, the arm moves on a horizontal plane to engage and release the blade from the blade holding compartment.

In yet another further embodiment, the blade lock and release device comprises a pin, and the pin is designed to allow the arm to be directly and pivotally attached to the blade holding compartment. In still another further embodiment, the pin is situated on a vertical plane. In still yet another further embodiment, the arm is perpendicular relative to the pin.

In another embodiment, the blade lock and release device further comprises a second spring. In yet another embodiment, the second spring has opposing ends, a first end being attached to at least a portion of the mechanism and at least a portion of the rear end of the blade holding mechanism.

In still another embodiment, the knife further comprises means for securing the faceplate to the blade holding compartment.

In still yet another embodiment, the arm is designed to fit within the second cavity of the blade holding device. In another further embodiment, the blade comprises at least one indentation which contacts the protrusion of the arm during the locked position.

In still a further embodiment, the present invention provides for a folding utility knife comprising: a handle pivotally connected to a blade holding compartment, the handle comprising at least two side walls forming a space, the space of the handle is designed to encase at least a portion of the blade holding compartment during a folded position, the blade holding compartment comprising at least one side wall having at least two internal cavities, the first cavity for holding a blade with at least two indentations, at least a portion of the blade holding compartment designed to be situated within the space of the handle during a folded position, the blade holding compartment comprises a front end, a rear end and a faceplate for covering the internal cavities, the front end of the blade compartment holder and at least a portion of the faceplate forming an opening at the front end of the blade holding compartment which allows a portion of the blade to protrude from the blade holding compartment; and a blade lock and release device comprising a moveable arm having front and rear portions, and the rear portion of the arm is pivotally attached adjacent to the rear end of the blade holding compartment, the arm is designed to fit within the second cavity of the blade holding compartment, the front portion of the arm having at least two protrusions for engagement and disengagement with the blade, the protrusions of the arm contacting the indentations of the blade during a locked position, the protrusions of the arm being moved away from the indentations of the blade to allow for the disengagement of the blade during a released position.

In another embodiment, the knife further comprises an interchangeable blade having at least one side with a sharp edge for cutting, at least a portion of the blade is situated within the blade cavity of the blade holding compartment and a portion of the blade is situated outside of the blade holding compartment to expose at least a portion of the sharp edge of the blade.

In yet another embodiment, the blade lock and release device further comprises a mechanism for allowing the engagement and disengagement of the arm with the blade, and the mechanism comprises a push and slide button and at least one spring.

In still another embodiment, the present invention relates to a utility knife having a blade holding compartment, and the compartment comprises at least one side wall having at least two internal cavities, the first cavity for holding a blade with at least two indentations, at least a portion of said blade holding compartment designed to be situated within the space of the handle during a folded position, the blade holding compartment comprises a front end, a rear end and a faceplate for covering the internal cavities, the front end of the blade compartment holder and at least a portion of the faceplate forming an opening at the front end of the blade holding compartment which allows a portion of the blade to protrude from the blade holding compartment; and a blade lock and release device comprising a moveable arm having front and rear portions, the rear portion of the arm is pivotally attached adjacent to the rear end of the blade holding compartment, the arm is designed to fit within the second cavity of the blade holding compartment, and the front portion of the arm having at least one protrusion for engagement and disengagement with the blade, the protrusion of the arm contacts the indentations of the blade during a locked position, the protrusion of the arm is moved away from the blade to allow for the disengagement of the blade during a released position, and the device comprising a push and slide mechanism allowing the engagement and disengagement of the arm with the blade.

In a further embodiment, the mechanism does not disengage with the blade when mechanism is accidentally contacted.

In another, embodiment, there are two protrusions on arm of the locking device and the protrusion situated closest to the front end of the blade holding compartment is tapered or thinner than the second protrusion. In another further embodiment, the cover plate functions to secure the springs and arm within the blade holding compartment.

In a further embodiment, the present invention provides for a folding utility knife comprising: a handle pivotally connected to a blade holding compartment, and the handle comprises at least two side walls forming a space; the space is designed to encase at least a portion of the blade holding compartment during a folded position, and the blade holding compartment comprises at least one side wall having at least two internal cavities, the first cavity for holding a blade with at least two indentations, and at least a portion of the blade holding compartment designed to be situated within the space of the handle during a folded position, and the blade holding compartment comprises a front end, a rear end and a faceplate for covering the internal cavities, and the front end of the blade compartment holder and at least a portion of said faceplate forming an opening at the front end of the blade holding compartment which allows a portion of the blade to protrude from the blade holding compartment; and a blade lock and release device comprises a moveable arm having front and rear portions, and the rear portion of the arm is pivotally attached adjacent to the rear end of the blade holding compartment, and the arm is designed to fit within the second cavity of the blade holding compartment, and the front portion of the arm has at least two protrusions for engagement and disengagement with the blade, and the blade lock and release device further comprises a mechanism for allowing the engagement and disengagement of the arm with the blade, and the mechanism comprises a push and slide button and at least two springs, the first spring is situated between said push and slide button and the arm of the blade lock and release device, the first spring contacts at least a portion of the push and slide button and at least a portion of the arm of the blade lock and release device, and the second spring is situated between the mechanism and the rear end of the blade holding mechanism, the second spring contacts at least a portion of the mechanism and at least a portion of the rear end of the blade holding mechanism, and said push and slide button is moved in one direction to allow said protrusions of said arm to contact the indentations of the blade during a locked position, said push and slide button is moved in another direction to allow said protrusions of said arm to be moved away from the indentations of the blade to allow for the disengagement of the blade during a released position.

BRIEF DESCRIPTION OF THE DRAWINGS

The accompanying drawings are included to provide a further understanding of the present invention. These drawings are incorporated in and constitute a part of this specification, illustrate one or more embodiments of the present invention and together with the description, serve to explain the principles of the present invention.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention that may be embodied in various forms. The figures are not necessarily to scale, some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Figures 1, 2:
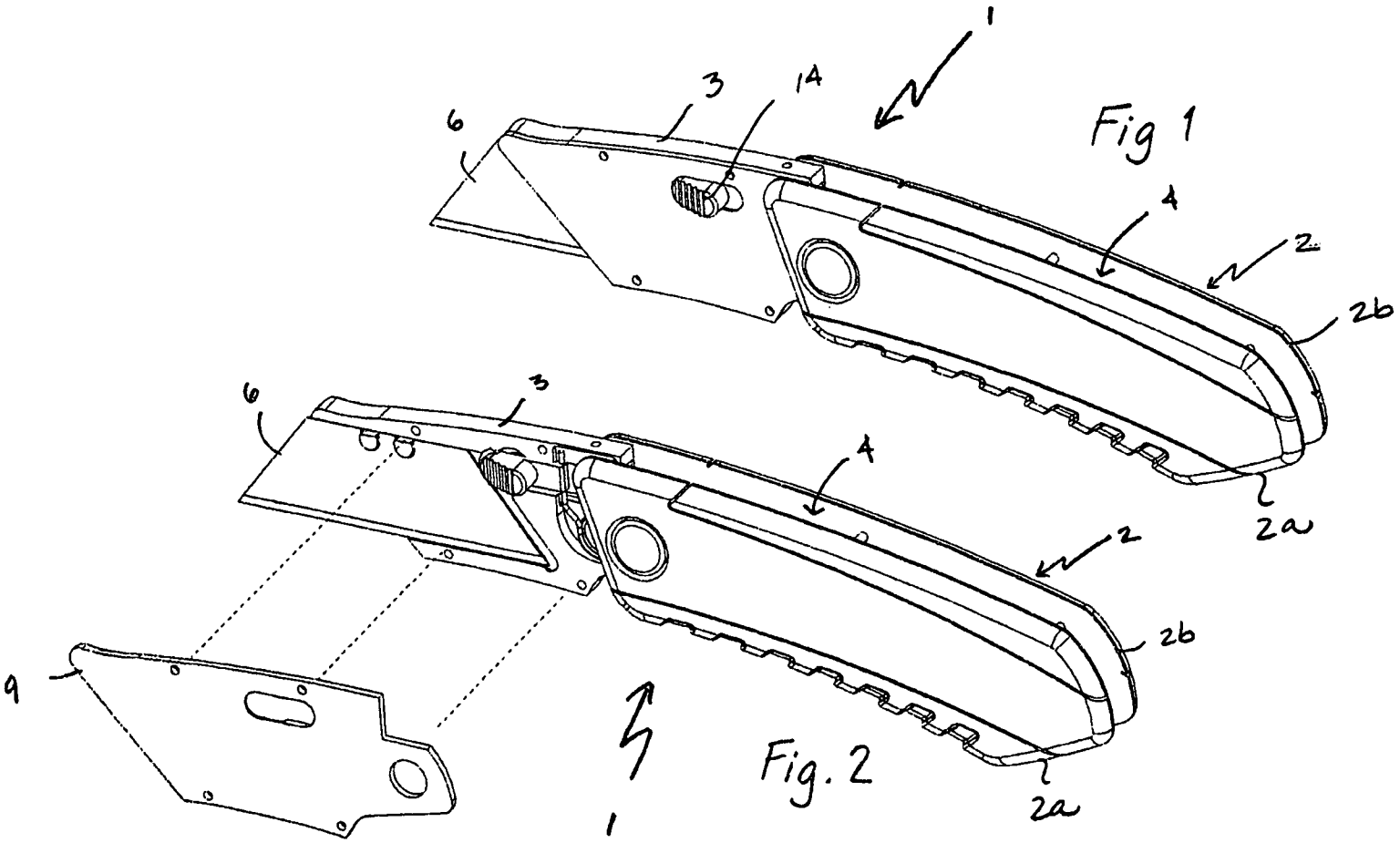
FIG. 1 is perspective view of the folding utility knife of the present invention with the blade lock and release mechanism.
FIG. 2 is a perspective view of FIG. 1 showing the blade holding compartment with an opened faceplate and the blade lock and release device with blade.
Figure 3:
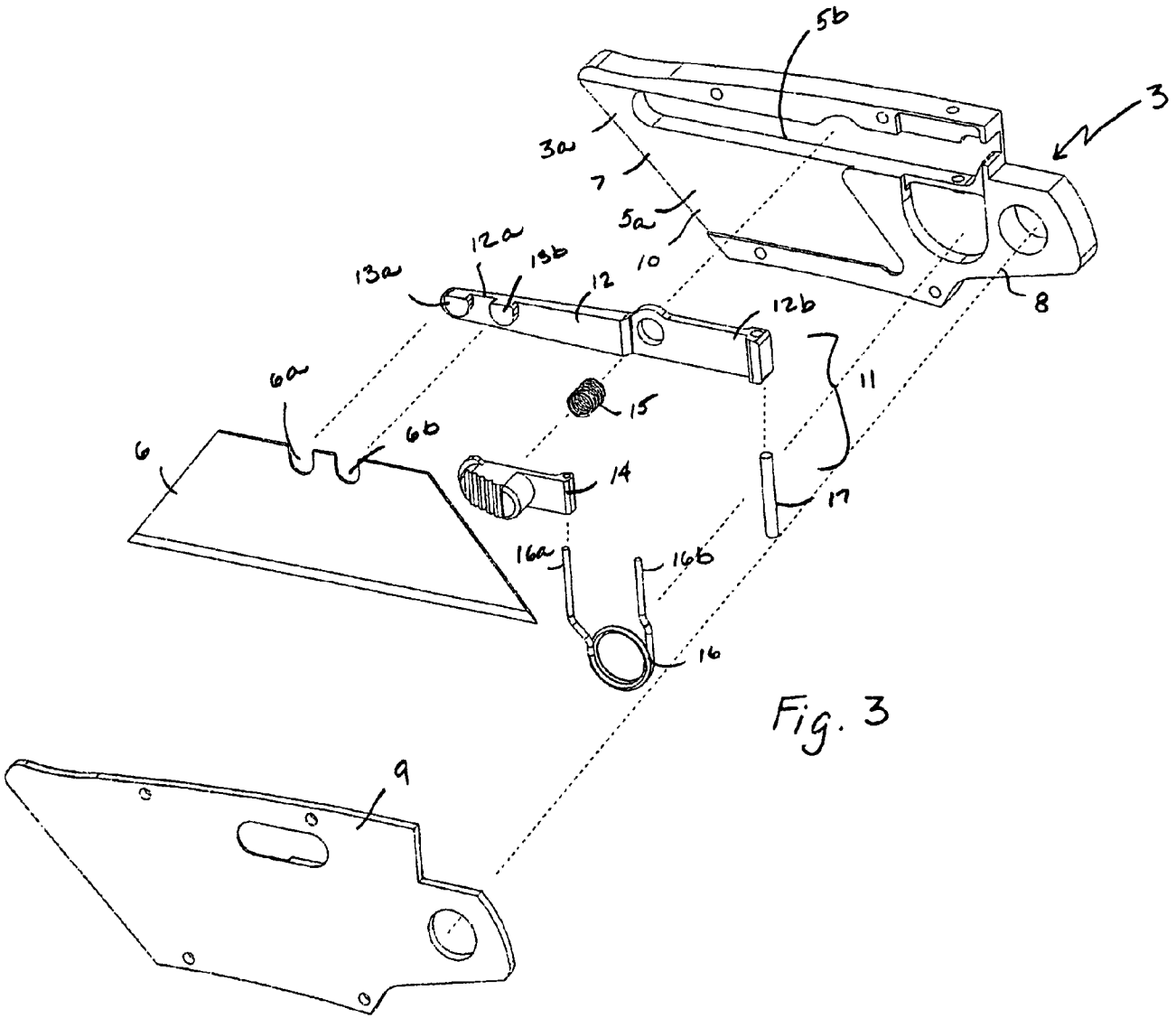
FIG. 3 is an exploded view of one of the embodiments of the blade lock and release device of the present invention.

FIGS. 1, 2 & 3 illustrate the knife 1 of the present invention with a handle 2 pivotally connected to a blade holding compartment 3. The handle 2 comprises at least two side walls 2*a* and 2*b* respectively, forming an internal space 4. The space 4 of the handle 2 is designed to encase at least a portion of the blade holding compartment 3 during a folded position. The blade holding compartment 3 comprises at least one side wall 3*a* having at least two internal cavities, 5*a* and 5*b* respectively. The first cavity 5*a* is designed for holding the blade 6 with at least two indentations 6*a* and 6*b* respectively. At least a portion of the blade holding compartment 3 is designed to be situated within the space 4 of the handle 2 during a folded position. The blade holding compartment 3 comprises a front end 7, a rear end 8 and a faceplate 9 for covering the internal cavities 5*a* and 5*b*. The front end 7 of the blade compartment holder 3 and at least a portion of the faceplate 9 forms an opening 10 at the front end 7 of the blade holding compartment 3 which allows a portion of the blade 6 to protrude from the blade holding compartment 3.

The knife 1 further comprises a blade lock and release device 11 comprising a moveable arm 12 having front and rear portions, 12*a* and 12*b* respectively, and the rear portion 12*b* of the arm 12 is pivotally attached adjacent to the rear end 8 of the blade holding compartment 3. The arm 12 is designed to fit within the second cavity 5*b* of the blade holding compartment 3, and the front portion 12*a* of the arm 12 has at least two protrusions, 13*a* and 13*b* respectively, for engagement and disengagement with the blade 6. The protrusions, 13*a* and 13*b*, of the arm 12 contact the indentations, 6*a* and 6*b*, of the blade 6 during a locked position. The protrusions, 13*a* and 13*b*, of the arm 12 are moved away from the indentations, 6*a* and 6*b*, of the blade 6 to allow for the disengagement of the blade 6 during a released position.

The blade lock and release device 11 further comprises a mechanism for allowing the engagement and disengagement of the arm with the blade such as a push and slide button 14 and at least two springs, 15 and 16 respectively.

The first spring 15 is situated between the push and slide button 14 and the arm 12 of the blade lock and release device 11. This spring 15 contacts at least a portion of the push and slide button 14 and at least a portion of the arm 12 of the blade lock and release device 11. The arm 12 moves on a horizontal plane to engage and release the blade 6 from the blade holding compartment 3.

The blade lock and release device 11 comprises a pin 17, and the pin 17 is designed to allow the arm 12 to be directly and pivotally attached to the blade holding compartment 3. The pin 17 is situated on a vertical plane and the arm 12 is perpendicular relative to the pin 17.

The second spring 16 has opposing ends, 16 and 16*b* respectively, and the first end 16*a* is attached to at least a portion of the button 14 and at least a portion of the rear end 3*b* of the blade holding mechanism 3.

Figures 4A, 4B, 4C, 4D:
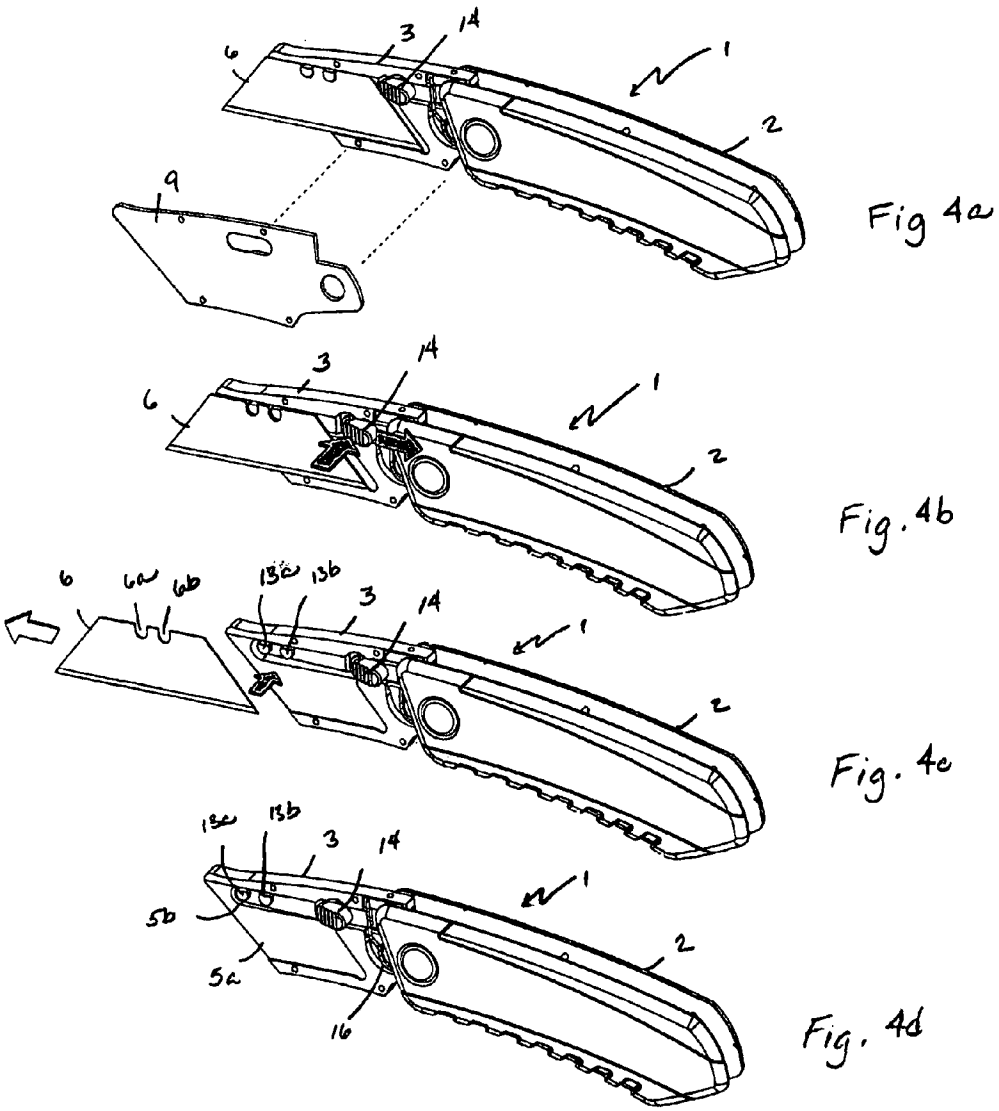
FIGS. 4*a-d* are perspective views of the how the blade is released from the blade holding compartment without the faceplate.
Figures 5A, 5B, 5C, 5D:
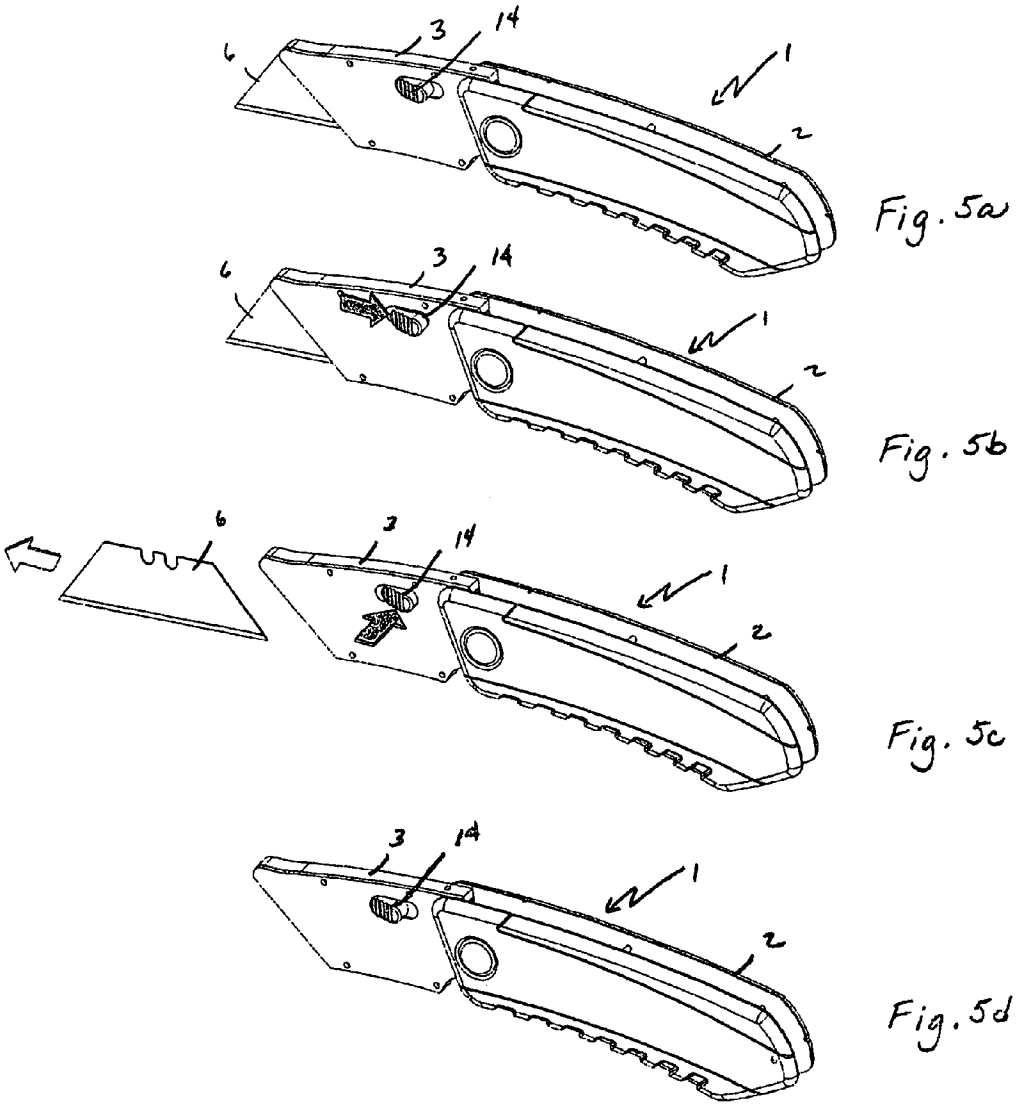
FIGS. 5*a-d* are perspective views of how the push and slide mechanism of the blade lock and release device functions.

FIGS. 4*a-d* show how the blade 6 is released from the blade holding compartment 3. FIG. 4*a* illustrates how the indentations 6*a* and 6*b* of the blade 6 contacts the protrusions 13*a* and 13*b* of the arm 12 during the locked position. FIGS. 4*b-c* show how the user pushes in and slides the button 14 back which allows the arm 12 to move away from the blade 6 to disengage the protrusions 13*a* and 13*b* of the arm 12 to separate from the indentations 6*a* and 6*b* of the blade 6 to thereby release the blade 6. FIG. 4*d* shows the blade holding compartment 3 without the blade 6 in the released position.

FIGS. 5*a-d* depicts the release of the blade 6 from the blade holding compartment 3 with the face plate 9 attached to the blade holding compartment 3. There is a safety mechanism so that when the button 14 is pushed in, it does not solely release the blade. The button 14 must be pushed in and then slid back to release the blade 6. The mechanism does not disengage with the blade 6 when mechanism is accidentally contacted.

Numerous modifications and variations of the present invention are possible in light of the above teachings. It is therefore to be understood that within the scope of the attendant claims attached hereto, this invention may be practiced otherwise than as specifically disclosed herein.

What is claimed is:

1. A folding utility knife comprising:

a handle comprising an internal space;

a blade holding compartment pivotally connected to said handle, said blade holding compartment comprising at least one side wall having at least two internal cavities, said first cavity for holding a blade, at least a portion of said blade holding compartment designed to be situated within said space of said handle during a folded position, said blade holding compartment comprising a front end, a rear end and a faceplate for covering said internal cavities, said front end of said blade compartment holder and at least a portion of said faceplate forming an opening at said front end of said blade holding compartment which allows a portion of the blade to protrude from said blade holding compartment; and a blade lock and release device comprising a moveable arm having front and rear portions, said rear portion of said arm being pivotally attached adjacent to said rear end of said blade holding compartment, said front portion of said arm having at least one protrusion for engagement and disengagement with the blade said blade lock and release device further comprises a mechanism for allowing the engagement and disengagement of said arm with the blade and at least two spring, one of said spring has opposing ends, a first end of one of said springs being attached to at least a portion of said mechanism and to at least a portion of said rear end of said blade holding mechanism, said mechanism comprises a push and slide button, said push and slide button is moved in one direction to allow said protrusions of said arm to contact the indentations of the blade during a locked position, said push and slide button is moved in another direction to allow said protrusions of said arm to be moved away from the indentations of the blade to allow for the disengagement of the blade during a released position.

2. The knife of claim 1 further comprising an interchangeable blade having at least one side with a sharp edge for cutting, at least a portion of said blade being situated within said blade cavity of said blade holding compartment and a portion of the blade being situated outside of the blade holding compartment to expose at least a portion of the sharp edge of said blade.

3. The knife of claim 1 wherein a second spring is situated between said push and slide button and said arm of said blade lock and release device.

4. The knife of claim 3 wherein said second spring contacts at least a portion of said push and slide button and at least a portion of said arm of said blade lock and release device.

5. The knife of claim 1 wherein said arm moves on a horizontal plane to engage and release the blade from said blade holding compartment.

6. The knife of claim 5 wherein said blade lock and release device comprises a pin, said pin is designed to allow said arm to be directly and pivotally attached to said blade holding compartment.

7. The knife of claim 6 wherein said pin is situated on a vertical plane.

8. The knife of claim 7 wherein said arm is perpendicular relative to said pin.

9. The knife of claim 1 further comprising means for securing said faceplate to said blade holding compartment.

10. The knife of claim 1 wherein said arm is designed to fit within said second cavity of said blade holding device.

11. The knife of claim 2 wherein said blade comprises at least one indentation which contact said protrusion of said arm during said locked position.

12. A folding utility knife comprising:

a handle pivotally connected to a blade holding compartment, said handle comprising at least two side walls forming a space, said space is designed to encase at least a portion of said blade holding compartment during a folded position, said blade holding compartment comprising at least one side wall having at least two internal cavities, said first cavity for holding a blade with at least two indentations, at least a portion of said blade holding compartment designed to be situated within said space of said handle during a folded position, said blade holding compartment comprising a front end, a rear end and a faceplate for covering said internal cavities, said front end of said blade compartment holder and at least a portion of said faceplate forming an opening at said front end of said blade holding compartment which allows a portion of the blade to protrude from said blade holding compartment; and a blade lock and release device comprising a moveable arm having front and rear portions, said rear portion of said arm being pivotally attached adjacent to said rear end of said blade holding compartment, said arm is designed to fit within said second cavity of said blade holding compartment, said front portion of said arm having at least two protrusions for engagement and disengagement with the blade, said blade lock and release device further comprises a mechanism for allowing the engagement and disengagement of said arm with the blade, said mechanism comprises a push and slide button and at least two springs, said first spring is situated between said push and slide button and said arm of said blade lock and release device, said first spring contacts at least a portion of said push and slide button and at least a portion of said arm of said blade lock and release device, said second spring is situated between said mechanism and said rear end of said blade holding mechanism, said second spring contacts at least a portion of said mechanism and at least a portion of said rear end of said blade holding mechanism, said push and slide button is moved in one direction to allow said protrusions of said arm to contact the indentations of the blade during a locked position, said push and slide button is moved in another direction to allow said protrusions of said arm to be moved away from the indentations of the blade to allow for the disengagement of the blade during a released position.

13. The knife of claim 12 further comprising an interchangeable blade having at least one side with a sharp edge for cutting, at least a portion of said blade being situated within said blade cavity of said blade holding compartment and a portion of the blade being situated outside of the blade holding compartment to expose at least a portion of the sharp edge of said blade.

14. The knife of claim 12 wherein said blade lock and release device further comprises a mechanism for allowing the engagement and disengagement of said arm with the blade, said mechanism comprises a push and slide button and at least one spring.

15. A utility knife having a blade holding compartment, said compartment comprises at least one side wall having at least two internal cavities, said first cavity for holding a blade with at least two indentations, at least a portion of said blade holding compartment designed to be situated within said space of said handle during a folded position, said blade holding compartment comprising a front end, a rear end and a faceplate for covering said internal cavities, said front end of said blade compartment holder and at least a portion of said faceplate forming an opening at said front end of said blade holding compartment which allows a portion of the blade to protrude from said blade holding compartment; and a blade lock and release device comprising a moveable arm having front and rear portions, said rear portion of said arm being pivotally attached adjacent to said rear end of said blade holding compartment, said arm is designed to fit within said second cavity of said blade holding compartment, said front portion of said arm having at least one protrusion for engagement and disengagement with the blade, said device comprising a push and slide mechanism allowing the engagement and disengagement of said arm with the blade, said blade lock and release device further comprising a mechanism for allowing the engagement and disengagement of said arm with the blade, said mechanism comprising a push and slide button and at least two springs, each of said first and second springs having opposing ends, said first end of said first spring contacts at least a portion of said push and slide button and said second end of said first spring contacts at least a portion of said arm of said blade lock and release device, said first end of said second spring being attached to at least a portion of said mechanism and said second end of said second spring being attached to at least a portion of said rear end of said blade holding mechanism, said push and slide button is moved in one direction to allow said protrusions of said arm to contact the indentations of the blade during a locked position, said push and slide button is moved in another direction to allow said protrusions of said arm to be moved away from the indentations of the blade to allow for the disengagement of the blade during a released position.

16. The knife of claim 15 wherein said mechanism does not disengage with the blade when mechanism is accidentally contacted.

* * * * *